US009096818B2

(12) United States Patent
Nunes et al.

(10) Patent No.: US 9,096,818 B2
(45) Date of Patent: Aug. 4, 2015

(54) AUTOMATIC DISHWASHING DETERGENT COMPOSITIONS COMPRISING ETHERCARBOXYLIC ACIDS OR THEIR SALTS AND NONIONIC SURFACTANTS WITH A HIGH CLOUD POINT

(75) Inventors: George Italo Pitombeira Nunes, Bad Soden (DE); Carsten Cohrs, Frankfurt (DE)

(73) Assignee: Clariant International Ltd., Muttenz (CH)

( * ) Notice: Subject to any disclaimer, the term of this patent is extended or adjusted under 35 U.S.C. 154(b) by 154 days.

(21) Appl. No.: 13/315,708

(22) Filed: Dec. 9, 2011

(65) Prior Publication Data

US 2013/0146097 A1 Jun. 13, 2013

(51) Int. Cl.

| | |
|---|---|
| ***C11D 1/83*** | (2006.01) |
| *C11D 1/06* | (2006.01) |
| *C11D 1/72* | (2006.01) |

(52) U.S. Cl.

CPC .. *C11D 1/83* (2013.01); *C11D 1/06* (2013.01); *C11D 1/72* (2013.01); *C11D 1/721* (2013.01)

(58) Field of Classification Search

CPC ..... C11D 1/04; C11D 3/2075; C11D 3/3707; C11D 1/72; C11D 1/83

USPC ..... 510/220, 367

See application file for complete search history.

(56) References Cited

U.S. PATENT DOCUMENTS

| | | | | |
|---|---|---|---|---|
| 3,941,710 | A | 3/1976 | Gilbert et al. | |
| 4,272,394 | A | 6/1981 | Kaneko | |
| 5,798,329 | A | 8/1998 | Taylor et al. | |
| 6,274,538 | B1 * | 8/2001 | Addison | 510/224 |
| 6,303,561 | B1 * | 10/2001 | Painter | 510/446 |
| 6,358,911 | B1 * | 3/2002 | Metzger-Groom | 510/446 |
| 6,399,564 | B1 * | 6/2002 | Speed et al. | 510/446 |
| 6,451,754 | B1 * | 9/2002 | Rowland et al. | 510/446 |
| 6,498,133 | B2 * | 12/2002 | Borchers et al. | 510/314 |
| 6,545,147 | B1 * | 4/2003 | Seebach et al. | 540/465 |
| 6,551,981 | B1 * | 4/2003 | Ricci et al. | 510/446 |
| 6,593,287 | B1 | 7/2003 | Jordan, IV et al. | |
| 6,599,871 | B2 * | 7/2003 | Smith | 510/446 |
| 6,686,328 | B1 * | 2/2004 | Binder | 510/446 |
| 6,770,616 | B1 * | 8/2004 | McGowan et al. | 510/446 |
| 6,974,789 | B1 * | 12/2005 | Whitaker et al. | 510/294 |
| 7,008,561 | B2 | 3/2006 | Dahlmann et al. | |
| 7,754,671 | B2 * | 7/2010 | Lin et al. | 510/340 |
| 2002/0107163 | A1 * | 8/2002 | Borchers et al. | 510/302 |
| 2002/0160930 | A1 * | 10/2002 | Emmerson et al. | 510/445 |
| 2006/0229230 | A1 * | 10/2006 | Bauer et al. | 510/475 |
| 2008/0051309 | A1 * | 2/2008 | Lin et al. | 510/341 |
| 2008/0113893 | A1 * | 5/2008 | Rowland et al. | 510/224 |
| 2010/0160204 | A1 | 6/2010 | Zipfel et al. | |

FOREIGN PATENT DOCUMENTS

| | | |
|---|---|---|
| DE | 19852973 | 7/2000 |
| DE | 10123210 | 10/2002 |
| EP | 268873 | 6/1988 |
| EP | 1757676 | 2/2007 |
| WO | WO 94/22800 | 10/1994 |

OTHER PUBLICATIONS

Written Opinion of the International Searching Authority for PCT/EP2012/005041, dated Dec. 6, 2012.
Written Opinion of the International Searching Authority for PCT/EP2012/005042, dated Dec. 6, 2012.
English Abstract of DE 19852973, dated Jul. 20, 2000.
English Abstract of EP 0268873, dated Jun. 1, 1988.
International Searching Report for PCT/EP2012/005041, dated Mar. 5, 2013.
International Preliminary Report on Patentability of the International Searching Authority for PCT/EP2012/005041, dated Mar. 7, 2014.
International Searching Report for PCT/EP2012/005042, dated Mar. 1, 2013.
International Preliminary Report on Patentability of the International Searching Authority for PCT/EP2012/005042, dated Dec. 19, 2013.
Barel, A. O., et al., "Handbook of Cosmetic Science and Technology", Marcel Dekker, 2001, pp. 432-433.
Kosswig, K., et al., "Die Tenside", Carl Hanser Verlag, 1993, pp. 122-123.
Farn, R. J., "Chemistry and Technology of Surfactants", 2006, pp. 126-127.

* cited by examiner

*Primary Examiner* — Gregory Webb
(74) *Attorney, Agent, or Firm* — Tod A. Waldrop

(57) ABSTRACT

The present invention relates to automatic dishwashing detergent compositions comprising a) one or more compounds of the formula (I)

$$RO-(CH_2CH_2O)_n-CH_2-COOM \quad (I)$$

wherein

R is a linear or branched saturated alkyl group comprising from 8 to 30 carbon atoms or a linear or branched unsaturated alkenyl group with one or more double bonds and comprising from 8 to 30 carbon atoms, n is a number from 1 to 20, and M is a counter ion, and b) one or more nonionic surfactants having a cloud point of 30° C. or more, and c) one or more builder substances.

The inventive automatic dishwashing detergent compositions in particular possess an advantageous anti-spotting behavior.

24 Claims, No Drawings

AUTOMATIC DISHWASHING DETERGENT COMPOSITIONS COMPRISING ETHERCARBOXYLIC ACIDS OR THEIR SALTS AND NONIONIC SURFACTANTS WITH A HIGH CLOUD POINT

The present invention is in the field of automatic dishwashing detergent compositions which comprise nonionic surfactants with a high cloud point of 30° C. or more and preferably of 40° C. or more and specific ethercarboxylic acids or ethercarboxylic acid salts.

Automatic dishwashing, especially domestic dishwashing has undergone continuous changes and improvement as the format moves into the direction of all-in-one dosing systems like tabs, pouches and even dosing units, demanding new surfactant systems which are effective as rinse aids against spotting and filming while they are present through the whole washing cycle. In addition, environmental trends, like washing at lower temperatures and with less water, the reduction or even ban of phosphates like sodium tripolyphosphate (STPP) and the demand to use raw materials from renewable resources instead of petroleum based chemicals challenge the formulator in his choice of surfactant system. On the other hand, the freedom to select suitable surfactants is limited by the unique requirement of very low foaming compositions, which is incompatible with most common surfactant systems typically used in other cleaning compositions, e.g. hand dishwashing liquids, where stable foam is seen as desirable.

It was an object of the present invention to provide automatic dishwashing detergent compositions which, besides a favorable cleaning performance, in particular also show a favorable anti-spotting behavior.

Surprisingly, it has now been found that this object is achieved with automatic dishwashing detergent compositions comprising a) one or more compounds of the formula (I)

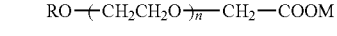

(I)

wherein

R is a linear or branched saturated alkyl group comprising from 8 to 30 carbon atoms or a linear or branched unsaturated alkenyl group with one or more double bonds and comprising from 8 to 30 carbon atoms, n is a number from 1 to 20, and M is a counter ion, and b) one or more nonionic surfactants having a cloud point of 30° C. or more and preferably having a cloud point of 40° C. or more, and c) one or more builder substances.

The present invention therefore provides automatic dishwashing detergent compositions comprising a) one or more compounds of the formula (I)

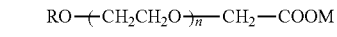

(I)

wherein

R is a linear or branched saturated alkyl group comprising from 8 to 30 carbon atoms or a linear or branched unsaturated alkenyl group with one or more double bonds and comprising from 8 to 30 carbon atoms, n is a number from 1 to 20, and M is a counter ion, and b) one or more nonionic surfactants having a cloud point of 30° C. or more and preferably having a cloud point of 40° C. or more, and c) one or more builder substances.

Due to the presence of the one or more surfactants of the formula (I) and the one or more nonionic surfactants of component b) the inventive automatic dishwashing detergent compositions show a favorable anti-spotting behavior and possess a favorable cleaning performance. The surfactants of the formula (I) and the one or more nonionic surfactants of component b) do not impart to major foaming and insofar the inventive compositions are furthermore low foaming. In particular, the surfactants of formula (I) are biodegradable and are based—due to their alcohol component RO—on renewable primary products and insofar the inventive automatic dishwashing detergent compositions are also environment-friendly. The same is true for preferred nonionic surfactants of component b) of the inventive automatic dishwashing detergent compositions such as the compounds of the formula (II).

The inventive automatic dishwashing detergent compositions furthermore have the advantage that the one or more surfactants of the formula (I) and the one or more nonionic surfactants of component b) contained therein reveal their advantageous properties and in particular provide a favorable anti-spotting behavior also in phosphate-free compositions. Compared with common low foaming non-ionic surfactants the combination of the one or more surfactants of the formula (I) and the one or more nonionic surfactants of component b) often lead to an improved anti-spotting behavior.

U.S. Pat. No. 4,272,394 discloses automatic dishwashing detergents containing blends of low foaming nonionic surfactants, where the second surfactant has a relatively low cloud point.

WO 94/22800 describes low cloud point epoxy capped poly(oxyalkylated) alcohols and automatic dishwasher compositions containing them.

U.S. Pat. No. 6,593,287 discloses alkyl-capped nonionic surfactants and automatic dishwashing compositions containing them.

EP 1 757 676 describes the use of charged surfactants including ethercarboxylates, namely alkylethoxycarboxylates, alkylethoxysulfates with specific chainlengths and EO (ethyleneoxy —$CH_2CH_2O$—) levels, sulfobetaines, alkylpolyethoxysulfates, alkylpolyetnoxycarboxylates and alkyl sulfates and sulfonates. However, it is mandatory that a low foaming nonionic, specifically a low cloud point surfactant with a cloud point below 30° C. in water is present in the composition to prevent the foaming issues.

In the one or more compounds of the formula (I) the counter ion M preferably is selected from the group consisting of $H^+$, $Na^+$, $K^+$, $Mg^{2+}/2$, $Ca^{2+}/2$, $NH_4^+$, monoethanolammonium, diethanolammonium and triethanolammonium.

Particularly preferably, in the one or more compounds of the formula (I) the counter on M is selected from the group consisting of $H^+$, $Na^+$ and $K^+$.

Examples for the alkyl and alkenyl groups R of the compounds of the formula (I) are e.g. the alkyl and alkenyl groups of the following alcohols R—OH: 1-octanol (capryl alcohol), 2-ethyl hexanol, 1-nonanol (pelargonic alcohol), 1-decanol (capric alcohol), 1-undecanol, 1-dodecanol (lauryl alcohol), 1-tridecanol, isotridecanol, 1-tetradecanol (myristyl alcohol), 1-pentadecanol, 1-hexadecanol (cetyl alcohol), cis-9-hexadecen-1-ol (palmitoleyl alcohol), 1-heptadecanol, 1-octadecanol (stearyl alcohol), cetearyl alcohol, 16-methylheptadecan-1-ol (isostearyl alcohol), 9E-octadecen-1-ol (elaidyl alcohol), cis-9-octadecen-1-ol (oleyl alcohol), oleylcetyl alcohol, 9Z, 12Z-octadecadien-1-ol (linoleyl alcohol), 9E, 12E-octadecadien-1-ol (elaidolinoleyl alcohol), 9Z, 12Z, 15Z-octadecatrien-1-ol (linolenyl alcohol), 9E, 12E, 15E-octadecatrien-1-ol (elaidolinolenyl alcohol), 1-nonadecanol, 1-eicosanol (arachidyl alcohol), 1-heneicosanol, 1-docosanol (behenyl alcohol), cis-13-docosen-1-ol (erucyl alcohol), 1-tetracosanol (lignoceryl alcohol), 1-hexacosanol (ceryl alcohol), 1-octacosanol (montanyl alcohol) and 1-triacontanol (myricyl alcohol) or mixtures of the above.

The groups R of the compounds of the formula (I) can be derived from naturally occurring alcohols R—OH which usually comprise mixtures of different residues R.

The groups R of the compounds of the formula (I) can also be derived from synthetically prepared alcohols R—OH such as oxo alcohols, e.g. oxo alcohol $C_{12-15}$.

In the one or more compounds of the formula (I) R preferably is a linear or branched saturated alkyl group comprising from 12 to 18 carbon atoms or a linear or branched unsaturated alkenyl group with one or more double bonds and comprising from 12 to 18 carbon atoms.

Particularly preferably, in the one or more compounds of the formula (I) R is a linear or branched saturated alkyl group comprising from 16 to 18 carbon atoms or a linear or branched unsaturated alkenyl group with one or more double bonds and comprising from 16 to 18 carbon atoms.

Preferably, in the one or more compounds of the formula (I) 50 wt.-% or more of the groups R are linear or branched unsaturated alkenyl groups with one or more double bonds.

Particularly preferably, in the one or more compounds of the formula (I) R is a linear group.

Even more preferred, in the one or more compounds of the formula (I) R is an oleylcetyl group.

In the one or more compounds of the formula (I) n preferably is a number from 1 to 3.

Particularly preferably, in the one or more compounds of the formula (I) n is 2.

The inventive automatic dishwashing detergent compositions comprise the one or more compounds of the formula (I) preferably in amounts from 0.1 to 15 wt.-%, more preferably in amounts from 0.2 to 10 wt.-% and particularly preferably in amounts from 0.2 to 5 wt.-%, in each case based on the total weight of the automatic dishwashing detergent composition.

The person skilled in the art knows which compounds can be used as nonionic surfactants of component b) of the inventive automatic dishwashing detergent compositions because such compounds are e.g. commercially available and their cloud points are known.

The cloud point of the nonionic surfactants of component b) of the inventive automatic dishwashing detergent compositions can also be determined according to DIN EN 1890.

The one or more nonionic surfactants of component b) of the inventive automatic dishwashing detergent compositions are preferably selected from the compounds of the formula (II)

$$R^1O\text{-}(\text{-}AO\text{—})_x\text{—}Z \qquad (II)$$

wherein $R^1$ is a linear or branched saturated alkyl group comprising from 8 to 30 carbon atoms or a linear or branched unsaturated alkenyl group with one or more double bonds and comprising from 8 to 30 carbon atoms, A is selected from the group consisting of —$C_2H_4$— and —$C_3H_6$—, x is a number from 1 to 150, Z is H, a linear or branched alkyl group having from 1 to 30 carbon atoms, or a group —CH(OH)—$R^3$, and $R^3$ is a linear or branched alkyl group having from 1 to 30 carbon atoms, and wherein the group -(-AO—)$_x$— comprises one or more —$C_2H_4O$-groups, and may additionally comprise one or more —$C_3H_6O$— groups, and in case the group -(-AO—)$_x$— simultaneously comprises —$C_2H_4O$— and —$C_3H_6O$—-groups, the —$C_2H_4O$— and —$C_3H_6O$— groups may be distributed over the -(-AO—)$_x$-group in any manner, preferably in a statistical, gradient-like or block-like manner and particularly preferably in a block-like manner, and the molar amount of the —$C_2H_4O$-groups in the group -(-AO—)$_x$— preferably is greater than the molar amount of the —$C_3H_6O$-groups.

Insofar the compounds of formula (II) do not have a cloud point as mentioned in component b) of the inventive automatic dishwashing detergent compositions they are not nonionic surfactants according to component b) of the inventive automatic dishwashing detergent compositions.

As examples for the alkyl and alkenyl groups $R^1$ of the compounds of the formula (II) the examples given above for the alkyl and alkenyl groups R of the compounds of the formula (I) can be mentioned.

$R^1$ in formula (II) preferably is a linear or branched saturated alkyl group comprising from 8 to 22 carbon atoms or a linear or branched unsaturated alkenyl group with one or more double bonds and comprising from 8 to 22 carbon atoms, more preferably a linear or branched saturated alkyl group comprising from 8 to 18 carbon atoms or a linear or branched unsaturated alkenyl group with one or more double bonds and comprising from 8 to 18 carbon atoms and particularly preferably a linear or branched saturated alkyl group comprising from 12 to 15 carbon atoms or a linear or branched unsaturated alkenyl group with one or more double bonds and comprising from 12 to 15 carbon atoms.

Preferably, the groups $R^1$ in formula (II) are alkyl groups.

x in formula (II) preferably is a number from 1 to 50, more preferably is a number from 1 to 20 and particularly preferably is a number from 5 to 20.

As examples for the alkyl groups Z and $R^3$ of the compounds of the formula (II) the examples given above for the alkyl groups R of the compounds of the formula (I) can be mentioned. Further examples are the alkyl groups methyl, ethyl, n-propyl, iso-propyl, n-butyl, sec.-butyl, iso-butyl, tert.-butyl, n-pentyl, sec.-pentyl (2-pentyl), 3-pentyl, 2-methylbutyl, iso-pentyl (3-methylbutyl), 3-methylbut-2-yl, 2-methylbut-2-yl, neopentyl (2,2-dimethylpropyl), 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 2,3-dimethyl-1-butyl, 3,3-dimethyl-1-butyl, 2,3-dimethyl-2-butyl, 3,3-dimethyl-2-butyl, 2-ethyl-1-butyl, 1-heptyl, 2-heptyl, 3-heptyl and 4-heptyl.

In case Z in formula (II) is a linear or branched alkyl group it preferably is an alkyl group having from 1 to 22 carbon atoms.

$R^3$ in formula (II) preferably is a linear or branched alkyl group having from 8 to 22 carbon atoms.

In a preferred embodiment of the invention the group -(-AO—)$_x$— consists of one or more —$C_2H_4O$-groups and comprises no —$C_3H_6O$-groups.

In a further preferred embodiment of the invention the group -(-AO—)$_x$— comprises one or more —$C_2H_4O$-groups and one or more —$C_3H_6O$-groups. In this preferred embodiment of the invention the molar amount of the —$C_3H_6O$-groups based on the total amount of —$C_2H_4O$— and —$C_3H_6O$-groups, preferably is less than 50%, more preferably is 45% or less than 45%, particularly preferably is 40% or less than 40% and especially preferably is 33% or less than 33%.

In a further preferred embodiment of the invention Z in formula (II) is H. In this preferred embodiment of the invention the molar amount of the —$C_3H_6O$-groups based on the total amount of —$C_2H_4O$— and —$C_3H_6O$-groups preferably is from 20 to less than 50%, more preferably is from 33 to 45% and particularly preferably is from 33 to 40%.

In case Z has a different meaning than H the molar amount of the —$C_3H_6O$-groups based on the total amount of —$C_2H_4O$— and —$C_3H_6O$-groups preferably is 20% or less than 20% and more preferably is 10% or less than 10%.

In a further preferred embodiment of the invention Z in formula (II) is an alkyl group having 1 to 4 carbon atoms. In this preferred embodiment of the invention the molar amount of the —$C_3H_6O$-groups based on the total amount of —$C_2H_4O$— and —$C_3H_6O$— groups preferably is 20% or less than 20% and more preferably is 10% or less than 10%.

In a further preferred embodiment of the invention Z in formula (II) is the group —CH(OH)—$R^3$ wherein $R^3$ is a linear or branched alkyl group having from 8 to 22 carbon atoms. In this preferred embodiment of the invention the molar amount of the —$C_3H_6O$-groups based on the total amount of —$C_2H_4O$— and —$C_3H_6O$-groups preferably is 20% or less than 20% and more preferably is 10% or less than 10%.

In a particularly preferred embodiment of the invention the one or more nonionic surfactants of component b) of the inventive automatic dishwashing detergent compositions on average (=molar average) comprise 8 —$C_2H_4O$-groups and 4 —$C_3H_6O$-groups and $R^1$ is a linear or branched saturated alkyl group comprising from 12 to 15 carbon atoms or a linear or branched unsaturated alkenyl group with one or more double bonds and comprising from 12 to 15 carbon atoms. In these nonionic surfactants of component b) of the inventive automatic dishwashing detergent compositions Z preferably is H.

The one or more nonionic surfactants of component b) of the inventive automatic dishwashing detergent compositions particularly preferably have a cloud point of 40 to 60° C.

The inventive automatic dishwashing detergent compositions comprise the one or more nonionic surfactants of component b) preferably in amounts from 0.1 to 15 wt.-%, more preferably in amounts from 0.2 to 10 wt.-% and particularly preferably in amounts of from 0.2 to 5 wt.-%, in each case based on the total weight of the automatic dishwashing detergent composition.

The variable "n" in the one or more compounds of the formula (I) and the variable "x" in the one or more compounds of the formula (II) represent molar averages, i.e. the inventive automatic dishwashing detergent compositions may comprise several compounds of the formula (I) that differ in the ethoxylation degree and several compounds of the formula (II) that differ in the alkoxylation degree.

The inventive automatic dishwashing detergent compositions may comprise more than one compound of the formula (I) and/or more than one nonionic surfactant of component b). In this case the inventive automatic dishwashing detergent compositions may e.g. comprise more than one compound of the formula (I) that differ in the group "R" and/or that differ in the ethoxylation degree and/or that differ in the counter ion "M" and/or more than one compound of the formula (II) that differ in the group "$R^1$" and/or that differ in the alkoxylation degree and/or that differ in the group "Z".

Preferably, the inventive automatic dishwashing detergent compositions are free of nonionic surfactants having a cloud point of less than 30° C.

The inventive automatic dishwashing detergent compositions comprise the one or more builder substances preferably in amounts from 5 to 90 wt.-% and more preferably in amounts from 5 to 80 wt.-%, in each case based on the total weight of the inventive automatic dishwashing detergent composition.

The builder substances as well as other ingredients usable in the inventive automatic dishwashing detergent compositions are e.g. described in US 2010/0160204 A1 and EP 1 757 676 A1.

Included among the builders are carbonates, hydrogencarbonates, organic builders, silicates, phosphates, phosphonates, methylglycinediacetic acid (MGDA), and alkali-metal hydroxides.

It is particularly preferred to use carbonate(s) and/or hydrogencarbonate(s), by preference alkali carbonate(s), particularly preferably sodium carbonate. These substances are preferably used in quantities from 2 to 50 wt.-%, by preference from 10 to 30 wt.-%, and in particular from 10 to 25 wt.-%, based on the total weight of the inventive automatic dishwashing detergent composition.

Organic builders include polycarboxylates/polycarboxylic acids, polymeric carboxylates, aspartic acid, polyacetals, and dextrins.

Usable organic builders include polycarboxylic acids, which can be used in the form of the free acid and/or its sodium salts, "polycarboxylic acids" being understood as those carboxylic acids that carry more than one acid function. Examples are citric acid, adipic acid, succinic acid, glutaric acid, malic acid, tartaric acid, maleic acid, fumaric acid, sugar acids, aminocarboxylic acids, and nitrilotriacetic acid (NTA), as well as mixtures thereof. Free acids typically also have an acidifying component in addition to their builder effect, and thus also serve to establish a lower and milder pH for the inventive automatic dishwashing detergent compositions. Worthy of mention in this context are, in particular, citric acid, succinic acid, glutaric acid, adipic acid, gluconic acid, and any mixtures thereof.

Particularly preferred inventive automatic dishwashing detergent compositions contain citrate as one of their builders. Inventive automatic dishwashing detergent compositions containing from 2 to 40 wt.-%, preferably from 5 to 30 wt.-%, and particularly from 10 to 30 wt.-% citrate, based on the total weight of the inventive automatic dishwashing detergent composition, are preferred.

Polymeric carboxylates are also suitable as organic builders. These are, for example, the alkali-metal salts of polyacrylic acid or of polymethacrylic acid, for example, those having a relative molecular weight from 500 to 70,000 g/mol.

Suitable polymeric carboxylates are, in particular, polyacrylates, preferably having a molecular weight from 2000 to 20,000 g/mol. Because of their superior solubility, short-chain polyacrylates having molar weights from 2000 to 10,000 g/mol, and particularly preferably from 3000 to 5000 g/mol, may in turn be preferred.

Also suitable are copolymeric carboxylates, in particular, those of acrylic acid with methacrylic acid, and acrylic acid or methacrylic acid with maleic acid. Copolymers of acrylic acid with maleic acid containing from 50 to 90 wt.-% acrylic acid and from 10 to 50 wt.-% maleic acid have proven particularly suitable. Their relative molecular weight, based on free acids, is preferably from 2000 to 70,000 g/mol, more preferably from 20,000 to 50,000 g/mol, and in particular from 30,000 to 40,000 g/mol.

In case the inventive automatic dishwashing detergent compositions comprise one or more (co)polymeric carboxylates, the amount of these (co)polymeric carboxylates in the inventive automatic dishwashing detergent compositions preferably is from 0.5 to 20 wt.-% and in particular from 3 to 10 wt.-%, based on the total weight of the inventive automatic dishwashing detergent composition.

Inventive automatic dishwashing detergent compositions may preferably contain, as a builder, crystalline sheet-form sodium silicates of the general formula $NaMSi_xO_{2x+1}.yH_2O$ wherein M is sodium or hydrogen; x is a number from 1.9 to 22, by preference from 1.9 to 4, particularly preferred values for x being 2, 3, or 4; and y is a number from 0 to 33, by preference from 0 to 20.

Also usable are amorphous sodium silicates having a $Na_2O:SiO_2$ modulus from 1:2 to 1:3.3, preferably from 1:2 to 1:2.8, and in particular from 1:2 to 1:2.6, which by preference are dissolution-delayed and exhibit secondary washing properties.

In case the inventive automatic dishwashing detergent compositions comprise one or more silicates, the amount of these silicates in the inventive compositions preferably is from 5 to 30 wt.-% and more preferably from 10 to 25 wt.-%, based on the total weight of the inventive automatic dishwashing detergent composition.

Phosphates have proven to be effective builders in terms of cleaning performance. Among the many commercially obtainable phosphates, alkali-metal phosphates have the greatest significance in the washing- and cleaning-agent industry, particularly pentasodium or pentapotassium triphosphate (sodium or potassium tripolyphosphate).

"Alkali-metal phosphates" is the summary designation for the alkali-metal (particularly sodium and potassium) salts of the various phosphoric acids, in which context a distinction can be made between metaphosphoric acids $(HPO_3)_m$ and orthophosphoric acid $H_3PO_4$, in addition to higher-molecular-weight representatives. Phosphates have a combination of advantages: they act as alkali carriers, prevent lime deposits on machine parts and contribute to cleaning performance.

Phosphates that are technically especially important are pentasodium triphosphate $Na_5P_3O_{10}$ (sodium tripolyphosphate) and the corresponding potassium salt pentapotassium triphosphate $K_5P_3O_{10}$ (potassium tripolyphosphate). Further preferred phosphates are the sodium potassium tripolyphosphates.

If phosphates are used in the inventive automatic dishwashing detergent compositions, preferred compositions contain phosphate(s), preferably alkali-metal phosphate(s), particularly preferably pentasodium or pentapotassium triphosphate (sodium or potassium tripolyphosphate) in quantities from 2 to 50 wt.-%, preferably from 2 to 30 wt.-%, more preferably from 3 to 25 wt.-%, and particularly preferably from 3 to 15 wt.-%, based in each case on the total weight of the inventive automatic dishwashing detergent composition.

As further builder(s), inventive automatic dishwashing detergent compositions can contain phosphonate(s). The weight proportion of phosphonate, based on the total weight of the inventive automatic dishwashing detergent composition, preferably is from 0.5 to 20 wt.-%, and more preferably from 1.0 to 10 wt.-%.

Complexing phosphonates include a number of different compounds such as 1-hydroxyethane-1,1-diphosphonic acid (HEDP) or diethylenetriaminepenta(methylenephosphonic acid) (DTPMP). Hydroxyalkane- and aminoalkanephosphonates are particularly preferred. Among the hydroxyalkanephosphonates, 1-hydroxyethane-1,1-diphosphonate (HEDP) is of particular importance, preferably as a cobuilder. It is preferably used as a sodium salt, the disodium salt reacting neutrally and the tetrasodium salt in alkaline fashion (pH 9). Suitable aminoalkanephosphonates include ethylenediaminetetramethylenephosphonate (EDTMP), diethylenetriaminepentamethylenephosphonate (DTPMP), and their higher homologs. They are preferably used in the form of the neutrally reacting sodium salts (e.g., as a hexasodium salt of EDTMP or as a hepta- and octasodium salt of DTPMP). Of the class of the phosphonates, HEDP is preferred.

As an alternative to phosphonates, methylglycinediacetic acid (MGDA) can also be used in the inventive automatic dishwashing detergent compositions as a complexing agent.

In case the inventive automatic dishwashing detergent compositions comprise methylglycinediacetic acid (MGDA), the amount of this compound in the inventive compositions preferably is from 0.5 to 25 wt.-% and more preferably from 5 to 20 wt.-%, based on the total weight of the inventive automatic dishwashing detergent composition.

Inventive automatic detergent dishwashing compositions can contain as further builders alkali-metal hydroxides. These alkali carriers are used preferably only in small quantities, preferably in quantities of 10 wt.-% or less, more preferably 6 wt.-% or less, by preference 5 wt.-% or less, particularly preferably from 0.1 to 5 wt.-%, and in particular from 0.5 to 5 wt.-%, based on the total weight of the inventive automatic detergent dishwashing composition.

In a further preferred embodiment of the invention the inventive automatic dishwashing detergent compositions comprise one or more builder substances selected from the group consisting of carbonates, citrates and phosphates. In a particularly preferred embodiment of the invention the inventive automatic dishwashing detergent compositions comprise one or more builder substances selected from the group consisting of carbonates and citrates.

The inventive automatic detergent dishwashing compositions can contain the aforementioned builders both individually and as mixtures of two, three, four or more builders.

The inventive automatic dishwashing detergent compositions preferably comprise a bleaching system. In case the inventive automatic dishwashing detergent compositions comprise a bleaching system they comprise the bleaching system preferably in amounts from 0.1 to 40 wt.-%, more preferably in amounts from 0.5 to 30 wt.-% and particularly preferably in amounts from 3 to 25 wt.-%, in each case based on the total weight of the inventive automatic dishwashing detergent composition.

The bleaching system of the inventive automatic dishwashing detergent compositions may comprise one or more substances selected from the group consisting of bleaching agents, bleach activators and bleach catalysts.

As a further ingredient, inventive automatic dishwashing detergent compositions can contain an oxygen bleaching agent. Among the compounds that serve as bleaching agents and yield $H_2O_2$ in water, sodium percarbonate, sodium perborate tetrahydrate, and sodium perborate monohydrate are particularly significant. Other usable bleaching agents include peroxypyrophosphates, citrate perhydrates, and peracid salts or peracids that yield $H_2O_2$, such as perbenzoates, peroxophthalates, diperazelaic acid, phthaloimino peracid, or diperdodecanedioic acid. Organic bleaching agents can also be used. Typical organic bleaching agents are diacyl peroxides such as dibenzoylperoxide. Further typical organic bleaching agents are peroxy acids such as alkylperoxy acids and arylperoxy acids.

Preferred inventive automatic dishwashing detergent compositions contain, based on the total weight of the composition, from 1.0 to 20 wt.-%, preferably from 4.0 to 18 wt.-%, and more preferably from 8 to 15 wt.-% of an oxygen bleaching agent, preferably sodium percarbonate.

In order to achieve an improved bleaching effect when cleaning at temperatures of about 60° C. and below, inventive automatic dishwashing detergent compositions can additionally contain bleach activators. Compounds that, under perhydrolysis conditions, yield aliphatic peroxycarboxylic acids having by preference 1 to 10 carbon atoms, in particular 2 to 4 carbon atoms, and/or optionally substituted perbenzoic acid, can be used as bleach activators. Substances that carry O— and/or N-acyl groups having the aforesaid number of carbon atoms, and/or optionally substituted benzoyl groups, are suitable. Polyacylated alkylenediamines are preferred, tetraacetylethylenediamine (TAED) having proven particularly suitable.

Bleach activators, in particular TAED, are preferably used in quantities of up to 10 wt.-%, in particular from 0.1 to 8 wt.-%, particularly from 2 to 8 wt.-%, and particularly preferably from 2 to 6 wt.-%, based in each case on the total weight of the bleach activator containing inventive automatic dishwashing detergent composition.

In addition to or instead of conventional bleach activators, so-called bleach catalysts can also be used. These substances are bleach-enhancing transition-metal salts or transition-metal complexes such as, for example, Mn, Fe, Co, Ru, or Mo salen complexes or carbonyl complexes. Mn, Fe, Co, Ru, Mo, Ti, V, and Cu complexes having nitrogen-containing tripod ligands, as well as Co, Fe, Cu, and Ru amine complexes, are also usable as bleach catalysts.

It is particularly preferred to use manganese complexes in oxidation states II, III, IV, or V, preferably containing one or more macrocyclic ligand(s) having the donor functions N, NR, PR, O, and/or S. Ligands having nitrogen donor functions are preferred. It is particularly preferred to use bleach catalyst(s) containing 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN), and/or 2-methyl-1,4,7-triazacyclononane (Me/TACN) as macromolecular ligands. Suitable manganese complexes include $[Mn^{III}_2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}_4(\mu\text{-}O)_6(TACN)_4](ClO_4)_4$, $[Mn^{III}_2(\mu\text{-}O)_1(\mu\text{-}OAc)_2(Me\text{-}TACN)_2](ClO4)_2$, $[Mn^{III}Mn^{IV}(\mu\text{-}O)_1(\mu\text{-}OAc)_2(Me\text{-}TACN)_2](ClO_4)_3$, $[Mn^{IV}_2(\mu\text{-}O)_3(Me\text{-}TACN)_2](PF_6)_2$, and $[Mn^{IV}_2(\mu\text{-}O)_3(Me/Me\text{-}TACN)_2](PF_6)_2(OAc{=}OC(O)CH_3)$.

In a further preferred embodiment of the invention the inventive automatic dishwashing detergent compositions contain a bleach catalyst chosen from bleach-enhancing transition-metal salts and transition-metal complexes, preferably from manganese complexes with 1,4,7-trimethyl-1,4,7-triazacyclononane (Me-TACN) or 1,2,4,7-tetramethyl-1,4,7-triazacyclononane ($Me_4$-TACN), since cleaning results can be significantly improved with these bleach catalysts.

Preferably, the bleaching system comprises one or more bleaching agents and one or more substances selected from the group consisting of bleach activators and bleach catalysts. Particularly preferably the bleaching system comprises one or more bleaching agents, one or more bleach activators and one or more bleach catalysts.

The inventive compositions may comprise other ingredients commonly used in automatic dishwashing detergent compositions. In a further preferred embodiment of the invention the inventive automatic dishwashing detergent compositions comprise one or more compounds selected from the group consisting of enzymes, glass corrosion inhibitors, water, organic solvents, thickening agents, further surfactants, suds suppressors, color speckles, silvercare, anti-tarnish and/or anti-corrosion agents, dyes, fillers, germicides, hydrotropes, anti-oxidants, enzyme stabilizing agents, perfumes, solubilizing agents, carriers, processing aids, pigments, and pH control agents.

In order to increase cleaning performance, inventive automatic dishwashing detergent compositions can also contain enzymes. These include proteases, amylases, lipases, hemicellulases, cellulases, perhydrolases, or oxidoreductases, as well as preferably mixtures thereof. These enzymes are, in principle, of natural origin. Improved variants based on the natural molecules are available for use in automatic dishwashing detergent compositions and are correspondingly preferred far use. Inventive automatic dishwashing detergent compositions contain enzymes preferably in amounts from $1\times10^{-6}$ to 5 wt.-%, based on active protein and furthermore based on the total weight of the inventive automatic dishwashing detergent compositions. Protein concentration can be determined by known processes such as the BCA process or biuret process.

A protein and/or enzyme can be protected, especially during storage, from damage such as inactivation, denaturing, or decomposition (e.g., resulting from physical influences, oxidation, or proteolytic cleavage). Inhibition of proteolysis is particularly preferred in microbial recovery of proteins and/or enzymes, particularly when the inventive automatic dishwashing detergent compositions also contain proteases. Inventive automatic dishwashing detergent compositions can contain stabilizers for this purpose; the provision of such agents in inventive automatic dishwashing detergent compositions represents a preferred embodiment of the present invention.

Those inventive automatic dishwashing detergent compositions containing, based on the total weight of the composition, from 0.1 to 12 wt.-%, by preference from 0.2 to 10 wt.-% and in particular from 0.5 to 8 wt.-% of enzyme preparation, are particularly preferred.

Glass corrosion inhibitors are further preferred ingredients of inventive automatic dishwashing detergent compositions. Glass corrosion inhibitors prevent the occurrence of clouding, smearing, and scratches, as well as iridescence, on the glass surface of automatically cleaned glassware. Preferred glass corrosion inhibitors include magnesium and zinc salts and magnesium and zinc complexes.

Inventive automatic dishwashing detergent compositions can be prepared in solid or liquid form, as well as a combination of solid and liquid presentation forms.

Because elevated alkalinity of the inventive automatic dishwashing detergent compositions contributes to the cleaning performance of these compositions, but also to the corrosive and irritating effect of these compositions, preferred inventive automatic dishwashing detergent compositions have a pH at 20° C. from 8 to 14, preferably from 9 to 11.5, more preferably from 9.5 to 11.5, measured as a solution of 10 wt.-% of the liquid or solid inventive automatic dishwashing detergent composition in water.

Cleaning performance of inventive automatic dishwashing detergent compositions can be improved by addition of organic solvents. A preferred embodiment of the present invention is therefore automatic dishwashing detergent compositions that contain at least one organic solvent. Preferred liquid inventive automatic dishwashing detergent compositions contain, based on the total weight of the composition, organic solvent in quantities from 0.2 to 15 wt.-%, by preference from 0.5 to 12 wt.-%, and particularly preferably from 1.0 to 10 wt.-%.

These organic solvents derive, for example, from monoalcohols, diols, trials or polyols, the ethers, esters, and/or amides. Organic solvents that are water-soluble are particularly preferred in this context, "water-soluble" solvents for purposes of the present application being solvents that are completely miscible with water (i.e. with no miscibility gap) at room temperature.

Organic solvents from organic amines and/or alkanolamines are effective in cleaning performance, and particularly with regard to cleaning performance on bleachable stains, in particular on tea stains.

In order to achieve the desired viscosity for liquid inventive automatic dishwashing detergent compositions, thickening agents can be added thereto. Thickening agents commonly used in automatic dishwashing detergent compositions can also be used in the inventive compositions.

It is advantageous if the respective liquid inventive automatic dishwashing detergent compositions contain the thickening agent in quantities preferably from 0.1 to 8 wt.-%, more preferably from 0.2 to 6 wt.-%, and particularly preferably from 0.4 to 4 wt.-%, based on the total weight of the inventive automatic dishwashing detergent composition.

The surfactants may be chosen from zwitterionic surfactants, anionic surfactants or mixtures thereof.

The zwitterionic surfactant preferably is chosen from the group consisting of $C_8$ to $C_{18}$ (preferably $C_{12}$ to $C_{18}$) amine oxides and sulfa and hydroxy betaines, such as N-alkyl-N,N-dimethylammino-1-propane sulfonate where the alkyl group can be $C_9$ to $C_{18}$, preferably $C_{10}$ to $C_{14}$.

The anionic surfactant preferably is chosen from alkylethoxysulfates, with the degree of ethoxylation greater than 3 (preferably 4 to 10; more preferably 6 to 8), and chain length in the range of $C_8$ to $C_{16}$, preferably $C_{11}$ to $C_{15}$. Additionally, branched alkylcarboxylates have been found to be useful for the purpose of the present invention when the branch occurs in the middle and the average total chain length is 10 to 18, preferably 12 to 16 with the side branch 2 to 4 carbons in length. An example is 2-butyloctanoic acid. The anionic surfactant is typically of a type having good solubility in the presence of calcium. Such anionic surfactants are further illustrated by sulfobetaines, alkyl(polyethoxy) sulfates (AES), and short chained $C_6$-$C_{10}$ alkyl sulfates and sulfonates. Straight chain fatty acids have been shown to be ineffective due to their sensitivity to calcium.

In a further preferred embodiment of the present invention, the inventive automatic dishwashing detergent compositions do not comprise other surfactants in addition to the one or more compounds of the formula (I) and the one or more nonionic surfactants of component b).

The suds suppressors, color speckles, silvercare, anti-tarnish and/or anti-corrosion agents, dyes, fillers, germicides, hydrotropes, anti-oxidants, enzyme stabilizing agents, perfumes, solubilizing agents, carriers, processing aids, pigments, and pH control agents can be chosen from the respective substances commonly used in automatic dishwashing detergent compositions.

In a further preferred embodiment of the invention the inventive automatic dishwashing detergent compositions do not comprise phosphates, i.e. they are phosphate-free.

In a further preferred embodiment of the invention the inventive automatic dishwashing detergent compositions are liquid at 20° C. Liquid presentation forms, preferably based on water and/or organic solvents, can exist in thickened form as gels. Preferably, the inventive liquid compositions comprise up to 60 wt.-% of water. more preferably from 10 to 60 wt.-% of water and even more preferably from 25 to 60 wt.-% of water, in each case based on the total weight of the inventive liquid automatic dishwashing detergent composition.

In a further preferred embodiment of the invention the inventive automatic dishwashing detergent compositions are solid at 20° C. Powders, granulates, extrudates, or compactates, particularly tablets, are especially suitable as solid presentation forms. Preferably, the inventive solid compositions comprise less than 20 wt.-% of water, more preferably from 0.1 to 20 wt.-% of water and even more preferably from 0.5 to 5 wt.-% of water, in each case based on the total weight of the inventive solid automatic dishwashing detergent composition. In another preferred embodiment of the invention the inventive automatic dishwashing detergent compositions are water-free.

The inventive automatic dishwashing detergent compositions are advantageously suited for washing tableware in automatic dishwashing machines, whereby soiled tableware is treated in an automatic dishwashing machine with an aqueous alkaline composition comprising an inventive automatic dishwashing detergent composition.

Therefore, the present invention also provides a method of washing tableware in an automatic dishwashing machine, comprising treating soiled tableware in an automatic dishwashing machine with an aqueous alkaline composition comprising an inventive automatic dishwashing detergent composition.

In the inventive method of washing tableware the pH value of the aqueous alkaline composition preferably is 8 or higher and more preferably 9 or higher.

The examples below are intended to illustrate the invention in detail without, however, limiting it thereto. Unless explicitly stated otherwise, all of the percentages are percentages by weight (% by wt. or wt %).

EXAMPLES

Dishwashing Detergent Performance Test (Spotting)

dishwasher: Miele G 222 SC GSL
items to test spotting: new items are all pre-treated with demineralized water in Normal eco program of a Bosch logixx dishwasher using 5 times the cleaner combination to be tested, then once 20 g of citric acid, finally once pure water
in the upper rack: 8 Hibal Schott "Paris" on the left and on the right
in the lower rack: 3 black porcelain plates
3 square black glass plates
8 blue melamine plates
in cutlery drawer with handles
to the middle OR in cutlery
basket with handles down: 8 knives "solid" by WMF
dishwasher program: no. 2 "short" (=R 0):
with pre-wash,
main wash at 55° C.,
rinse cycle at 65° C.
amount of water; 4.6 to 4.8 liter per each of the 4 water-intakes for pre-wash, main wash, intermediate rinse and final rinse
water hardness: 14° dH (tap water)
water softening: none
cleaner dosage: 20 g of a powder cleaner or 1 tab, respectively, in the dosing chamber
soil: a bottle top down with 50 g of frozen modified Stiwa soil added immediately after the dosage chamber opened (i.e. 14 minutes after program start)
rinse-aid: none
number of cleaning cycles: 3
time to cool down: 10 minutes with closed door, then the door is opened and the racks are drawn out completely evaluation: 30 minutes later when the test items are dry and cold rating: 8: no spots or streaks to 0: very numerous large spots and/or streaks filming is only mentioned when it is so serious that the spots are not to be seen after the test: machine is cleaned once with 20 g of citric acid, once with pure water in the test program Preparation of Soils and Soil Composition:

Recipe for the preparation of 5 kg of soil:

| | | |
|---|---|---|
| A | margarine | 500 g |
| B | gravy powder (Maggi) | 125 g |
| | potato starch | 25 g |
| | benzoic acid | 5 g |
| C | yolk size M | 15 g |
| | mustard (Streuber) | 125 g |
| | ketchup (Heinz) | 125 g |
| | milk with 1.5% fat | 250 g |
| D | tap water | 3.50 liter |

I A is melted in a 1 liter-beaker with the microwave at 600 W for 5 minutes.

II The components of B are added one after another to I by mixing well with a hand-held blender.

III The components of C are added one after another into a 10 liter-pail and blended well with the blender.

IV When II is lukewarm, it is added to III by mixing thoroughly.

V Then the water is stirred into IV in steps of about 0.5 to 1 liter, and the mixture is homogenized.

VI The soil is weighed by 50 g into square 100 ml-jars. In between it is mixed up with the blender.

Evaluation of Results—Visual Grading:

8: free of spots and stripes

7: few very thin stripes and/or few very small spots

6: few thin stripes and/or some small spots

5: thin to medium stripes and/or few medium sized spots and/or numerous small spots 4: few medium stripes and/or some medium sized spots 3: medium stripes and/or few large spots and/or numerous medium sized spots 2: few broad stripes and/or some large spots and/or very numerous medium sized spots 1: broad stripes and/or numerous large spots 0: very large stripes and/or very numerous large spots The single gradings for each test item are added together and the sum is used to compare the different detergent compositions.

Composition of the Tested Automatic Dishwashing Detergent Compositions

| Component | Chemical name | % by wt. a.i. |
|---|---|---|
| Sodium disilicate amorphous | | 20.0 |
| Soda ash (heavy) | Sodium carbonate | 15.0 |
| Trisodium citrate dihydrate | | 25.0 |
| Trilon ® M Powder (BASF) | Trisodium salt of methylglycinediacetic acid | 15.0 |
| Sokalan ® PA 30 CL (BASF) | Acrylic acid, homopolymer | 5.0 |
| Sodium percarbonate | | 12.0 |
| Peractive ® AC (Clariant) | Tetraacetyl ethylenediamine | 2.5 |
| Savinase 8.0 T (Novozymes) | | 1.0 *) |
| Termamyl 120 T (Novozymes) | | 1.0 *) |
| Surfactant system | | 3.5 |

a.i.: active ingredient

*) the amount in wt.-% is not related to the active ingredient but to the product as is

| | | |
|---|---|---|
| | Example 1 | |
| Surfactant system: | Oleylcetyl ethercarboxylic acid with 2 EO EO: ethylene oxide unit (Emulsogen ® COL 020) | 42% by wt. |
| | Oxo Alcohol $C_{12-15}$ ethoxylated, propoxylated with a cloud point of 42° C. (1 wt.-% in water) (Genapol ® EP 2584) | 58% by wt. |
| | Comparative Example 1 | |
| Surfactant system: | Oleylcetyl ethercarboxylic acid with 2 EO (Emulsogen ® COL 020) | 100% by wt. |
| | Comparative Example 2 | |
| Surfactant system: | Oxo Alcohol $C_{12-15}$ ethoxylated, propoxylated with a cloud point of 42° C. (1 wt.-% in water) (Genapol ® EP 2584) | 100% by wt. |
| | Comparative Example 3 | |
| Surfactant system: | Oleylcetyl ethercarboxylic acid with 2 EO (Emulsogen ® COL 020) | 40% by wt. |
| | nonionic surfactant with cloud point of 18° C. (1% by wt. in water), (1,2 Epoxydodecane capped C8/10 alcohol + 40 EO) | 60% by wt. |

The values for the total result spotting using the compositions of Example 1 and of the Comparative Examples 1, 2 and 3 are given in the following Table A.

TABLE A

Values for the total result spotting

| Composition | Total result spotting [points] (maximum: 240 points) |
|---|---|
| Example 1 | 138 |
| Comparative Example 1 | 132 |
| Comparative Example 2 | 124 |
| Comparative Example 3 | 105 |

From the results of Table A above one can see that the use of the inventive composition of Example 1 results in better values for the total result spotting compared to the use of the compositions according to the Comparative Examples 1, 2 and 3.

Furthermore, in the above example the inventive composition of Example 1 shows a very good overall cleaning performance.

The invention claimed is:

1. An automatic dishwashing detergent composition consisting essentially of a) at least one compound of formula (I)

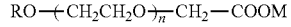

(I)

wherein

R is a linear or branched saturated alkyl group comprising from 8 to 30 carbon atoms or a linear or branched unsaturated alkenyl group with at least one double bond and comprising from 8 to 30 carbon atoms, n is a number from 1 to 20, and M is a counter ion, b) at least one nonionic surfactant having a cloud point of 30° C. or more, c) at least one builder substance, d) a bleaching system, and e) other ingredients commonly used in automatic dishwashing detergent compositions, wherein in the at least one compound of the formula (I), at least 50 wt.-% of the groups R are linear or branched unsaturated alkenyl groups with at least one double bond.

2. The automatic dishwashing detergent composition according to claim 1, wherein the counter ion M in the at least one compound of the formula (I) is selected from the group consisting of $H^+$, $Na^+$, $K^+$, $Mg^{2+}/2$, $Ca^{2+}/2$, $NH_4^+$, monoethanolammonium, diethanolammonium and triethanolammonium.

3. The automatic dishwashing detergent composition according to claim 1, wherein the counter ion M in the at least one compound of the formula (I) is selected from the group consisting of $H^+$, $Na^+$and $K^+$.

4. The automatic dishwashing detergent composition according to claim 1, wherein R in the at least one compound of the formula (I) is a linear or branched saturated alkyl group comprising from 12 to 18 carbon atoms or a linear or branched unsaturated alkenyl group with at least one double bond and comprising from 12 to 18 carbon atoms.

5. The automatic dishwashing detergent composition according to claim 1, wherein R in the at least one compound of the formula (I) is a linear or branched saturated alkyl group comprising from 16 to 18 carbon atoms or a linear or branched unsaturated alkenyl group with at least one double bond and comprising from 16 to 18 carbon atoms.

6. The automatic dishwashing detergent composition according to claim 1, wherein R in the at least one compound of the formula (I) is a linear group.

7. The automatic dishwashing detergent composition according to claim 1, wherein R in the at least one compound of the formula (I) is an oleylcetyl group.

8. The automatic dishwashing detergent composition according to claim 1, wherein n in the at least one compound of the formula (I) is a number from 1 to 3.

9. The automatic dishwashing detergent composition according to claim 1, wherein that n in the at least one compound of the formula (I) is 2.

10. The automatic dishwashing detergent composition according to claim 1, wherein it comprises the at least one compound of the formula (I) in amounts from 0.1 to 15 wt.-% in each case based on the total weight of the automatic dishwashing detergent composition.

11. The automatic dishwashing detergent composition according to claim 1, wherein the at least one nonionic surfactant of component b) is selected from the group consisting of compounds of the formula (II)

$$R^1O—(-AO—)_x—Z \quad (II)$$

wherein $R^1$ is a linear or branched saturated alkyl group comprising from 8 to 30 carbon atoms or a linear or branched unsaturated alkenyl group with at least one double bond and comprising from 8 to 30 carbon atoms, A is selected from the group consisting of $—C_2H_4—$ and $—C_3H_6—$, x is a number from 1 to 150, Z is H, a linear or branched alkyl group having from 1 to 30 carbon atoms, or a group $—CH(OH)—R^3$, and $R^3$ is a linear or branched alkyl group having from 1 to 30 carbon atoms, and wherein the group $-(-AO—)_x-$ comprises at least one $—C_2H_4O—$ group, and may additionally comprise at least one $—C_3H_6O—$ group, and in case the group $-(-AO—)_x-$ simultaneously comprises $—C_2H_4O—$ and $—C_3H_6O—$ groups, the $—C_2H_4O—$ and $—C_3H_6O—$ groups may be distributed over the $-(-AO—)_x$group in any manner.

12. The automatic dishwashing detergent composition according to claim 11, wherein the at least one nonionic surfactant of component b) on average comprises 8 $—C_2H_4O—$ groups and 4 $—C_3H_6O—$ groups, $R^1$ is a linear or branched saturated alkyl group comprising from 12 to 15 carbon atoms or a linear or branched unsaturated alkenyl group with at least one double bond and comprising from 12 to 15 carbon atoms and Z is H.

13. The automatic dishwashing detergent composition according to claim 1, wherein it comprises the at least one nonionic surfactant of component b) in amounts from 0.1 to 15 wt.-% in each case based on the total weight of the automatic dishwashing detergent composition.

14. The automatic dishwashing detergent composition according to claim 1, wherein it is free of nonionic surfactants having a cloud point of less than 30° C.

15. The automatic dishwashing detergent composition according to claim 1, wherein it comprises the at least one builder substance in amounts from 5 to 90 wt.-% in each case based on the total weight of the automatic dishwashing detergent composition.

16. The automatic dishwashing detergent composition according to claim 1, wherein the bleaching system comprises at least one substance selected from the group consisting of bleaching agents, bleach activators and bleach catalysts.

17. The automatic dishwashing detergent composition according to claim 1, wherein the bleaching system is present in amounts from 0.1 to 40 wt.-% in each case based on the total weight of the automatic dishwashing detergent composition.

18. The automatic dishwashing detergent composition according to claim 1, wherein the other ingredients commonly used in automatic dishwashing detergent compositions are selected from the group consisting of enzymes, glass corrosion inhibitors, water, organic solvents, thickening agents, further surfactants, suds suppressors, color speckles, silvercare, anti-tarnish and/or anti-corrosion agents, dyes, fillers, germicides, hydrotropes, anti-oxidants, enzyme stabilizing agents, perfumes, solubilizing agents, carriers, processing aids, pigments, and pH control agents.

19. The automatic dishwashing detergent composition according to claim 1, wherein it does not comprise other surfactants in addition to the at least one compound of the formula (I) and the at least one nonionic surfactant of component b).

20. A method of washing tableware in an automatic dishwashing machine, comprising treating soiled tableware in an automatic dishwashing machine with an aqueous alkaline composition comprising an automatic dishwashing detergent composition consisting essentially of a) at least one compound of formula (I)

$$RO—(CH_2CH_2O)_n—CH_2—COOM \quad (I)$$

wherein

R is a linear or branched saturated alkyl group comprising from 8 to 30 carbon atoms or a linear or branched unsaturated alkenyl group with at least one double bond and comprising from 8 to 30 carbon atoms, n is a number from 1 to 20, and M is a counter ion, b) at least one nonionic surfactant having a cloud point of 30 ° C. or more, c) at least one builder substance, d) a bleaching system, and e) other ingredients commonly used in automatic dish-washing detergent compositions, wherein in the at least one compound of the formula (I), at least 50 wt.-% of the groups R are linear or branched unsaturated alkenyl groups with at least one double bond.

21. The method according to claim 20, wherein the pH value of the aqueous alkaline composition is 8 or higher.

22. The method according to claim 20, wherein the pH value of the aqueous alkaline composition is 9 or higher.

23. The automatic dishwashing detergent composition according to claim 1, having a cloud point of 40° C. or more.

24. The automatic dishwashing detergent composition as claimed in claim 1, wherein the bleaching system comprises an oxygen bleaching agent selected from the group consisting of sodium percarbonate, sodium perborate tetrahydrate and sodium perborate monohydrate.

* * * * *